United States Patent [19]

Brill et al.

[11] 3,933,670

[45] Jan. 20, 1976

[54] PROCESS FOR MAKING AGGLOMERATED DETERGENTS

[75] Inventors: John B. Brill, St. Paul; Charles A. Morris, New Brighton; Soo-Duck Moon, Bloomington, all of Minn.

[73] Assignee: Economic Laboratories, Inc., St. Paul, Minn.

[22] Filed: Nov. 12, 1973

[21] Appl. No.: 414,766

[52] U.S. Cl. ..... 252/99; 23/313; 252/DIG. 1; 252/109; 252/135; 252/383

[51] Int. Cl.[2] ..... C11D 7/56

[58] Field of Search ..... 252/99, 109, 135, DIG. 1, 252/383; 23/313

[56] References Cited

UNITED STATES PATENTS

| | | | |
|---|---|---|---|
| 3,306,858 | 2/1967 | Oberle | 252/99 |
| 3,598,743 | 8/1971 | Coates | 252/99 |
| 3,609,088 | 9/1971 | Sumner | 252/99 |
| 3,852,212 | 12/1974 | Groening et al. | 252/99 X |

*Primary Examiner*—Mayer Weinblatt
*Attorney, Agent, or Firm*—Thomas M. Meshbesher

[57] ABSTRACT

A mixture of non-agglomerated particles of condensed phosphate salt, detergent builder salt and solid chlorine-releasing agent are agglomerated (i.e. formed into composite, enlarged particles) on an inclined, generally planar sliding bed. The residence time in the agglomerator can be reduced below 2 minutes and even below one minute with no adverse effect upon chlorine stability or anti-caking properties, if at least about two moles of water (e.g. more than about 8 or 9 wt. % water) are added to each mole of condensed phosphate used in the composition prior to the time the condensed phosphate contacts the sliding bed. The resulting agglomerated particles which emerge from the agglomerator generally contain less than 25 wt. % moisture and are relatively free-flowing. They are conveyed to a drying zone and raised to a temperature of at least about 33° C. in order to substantially eliminate unbound moisture and to decompose any thermally unstable hydrates (e.g. higher hydrates of sodium carbonate) which have been formed during the agglomeration step.

17 Claims, No Drawings

PROCESS FOR MAKING AGGLOMERATED DETERGENTS

FIELD OF THE INVENTION

This invention relates to a continuous process for agglomerating particles to form a detergent composition comprising enlarged, composite particles; that is, each agglomerated particle comprises a combination of all or substantially all of the ingredients of the total composition and is larger than any particulate component that went into it. An aspect of this invention relates to a continuous agglomeration process wherein particulate solids are fed to an agglomerator of the inclined disc type and are sprayed with water (i.e. water per se or water containing dissolved or suspended solids) to cause the particles of the intimately blended solid detergent ingredients to stick together and form enlarged, composite particles, i.e. agglomerates. Another aspect of this invention relates to an art-recognized alternative to dry mixing of detergent ingredients or mixing of detergent ingredients in an aqueous or nonaqueous slurry. This alternative is generally known as the rotating-disc type of agglomeration process. Still another aspect of this invention relates to an improvement over the process described in German Offenlegungschrift 2,056,701 (Brill et al), laid open July 8, 1971 (equivalent to French Pat. No. 70-42401, publication No. 2072413, delivery date Aug. 30, 1971).

DESCRIPTION OF THE PRIOR ART

There is an extremely voluminous body of patent and industrial literature relating to agglomeration and other techniques for achieving good quality control over detergent compositions. Several major companies have done considerable work in this field and have published extensively on their work, at least in the patent literature. Thus, the prior art offers the skilled detergent formulator a large number of alternative routes to a stable, well-controlled product.

Of all these various routes, the so-called agglomeration technique can, under appropriate circumstances, oftentimes provide a number of known advantages, including enhanced control over particle size and particle density. It has also been recognized that each particle can comprise an intimate mixture of all or several of the ingredients of the detergent composition, thus greatly reducing or even eliminating the possibility of segregation of the ingredients during shipping and storage.

The advantages of agglomeration are believed to be maximized in a continuous, single-stage, inclined pan or disc process, whereby all of the essential ingredients of the detergent composition are continuously fed (e.g. by gravity feed or spraying) as solids or in liquid form (e.g. liquid non-ionic surfactants and/or aqueous media) onto the disc, so that they become agglomerated into enlarged, composite particles by the sliding and scouring or rotating action of the resulting bed. This type of single-stage agglomeration is distinct from "falling curtain" processes or batch processes or other processes not involving a generally planar, inclined, sliding bed and is also distinct from any process in which two or more agglomerates or an agglomerate and a non-agglomerated particulate solid are combined. For example, a significant advantage of continuous single-stage sliding bed processes is the high volume throughput (i.e. rapid production rate) made possible by sliding bed technology and by the need for only the single-stage of agglomeration. By "single-stage agglomeration process" is meant a process wherein there is essentially only one agglomeration step. If there be any mixing or blending steps preceding agglomeration (and ordinarily there are no significant pre-mixing steps), these steps do not produce any significant size enlargement. Furthermore, except for desirable but generally non-essential ingredients such as dyes, perfumes, and the like, there are no ingredients added after agglomeration. In a single-stage process, recycled fines, sanitizing agents, hardness-sequestering salts, builder salts and anti-corrosion agents, and the like can all be present on the sliding bed during agglomeration.

In the aforementioned Germain laid-open application 2,056,701 (hereinafter referred to as DT-OS '701), a single-stage agglomeration process for almost any type of detergent composition is disclosed. Residence times in the rotating disc agglomerator are said to be 2 – 15 minutes. ("Residence time" for such a process is usually defined as the weight of material on the agglomeration bed at any given instant during the practice of process, divided by the total feed rate, i.e. the rate at which all raw materials are added to the disc, including all solids, water, non-ionic liquids, etc.) The disclosure of DT-OS '701 reports generally good properties for the resulting agglomerate, including rapid cup dispensing, i.e. resistance to caking in the detergent cup of a mechanical dishwasher; resistance to caking during storage; good stability for chlorine-releasing agents in the composition; etc. However, subsequent experience with the DT-OS '701 process has shown that the properties of the agglomerate can be dependent upon a set of factors which is more complex than originally recognized.

First, the end use of the product is significant. Some products made with the DT-OS '701 process comprised detergent formulations specifically designed for cleaning coffee pots and the like, and quality control is in some respects less difficult for such products; for example, rapid cup-dispensing properties are not needed.

Second, the residence time in the agglomerator has been found to have an effect upon several properties of the resulting product. Although the entire range of 2 – 15 minutes (DT-OS '701, page 13, line 6) appears to be operative, a rate-determining step of some sort (which apparently affects primarily the machine dishwashing detergents rather than coffee pot cleaners and the like) can often times reduce the utility of the shorter residence times (e.g. less than 6 minutes) and cause residence times less than 2 minutes to be highly undesirable.

Third, sanitizing agent stability during storage, caking during storage, and other stability or performance factors have more recently been found to be apparently dependent upon the ambient temperature during storage. The agglomerated product produced by the DT-OS '701 process is dry, free-flowing, and stable (e.g. chlorine stable) at normal ambient temperatures such as 20° – 25°C. However, after storage at temperatures in the range of 30° – 45°C., caking of detergent in the package, "cup caking" (slow cup dispensing) during use, and chlorine losses begin to become evident. (Warm weather, particularly in the southern United States, can cause the temperature inside an uncooled warehouse to climb well into the 30° – 45°C. range.)

Fourth, it has been found that drying conditions and/or ageing of the agglomerates discharged from the sliding bed can contribute to poor performance of machine diswashing detergents. Drying should be uniform throughout the agglomerated particle, i.e. from surface to core. Too much or too rapid drying can result in the formation of undesired water insoluble material (e.g. insoluble silicates) in the particle. Too little drying can lead to a variety of performance and stability problems. Furthermore, a hot, humid environment (e.g. the inside of a rotating drum dryer) is not usually favorable to the stability of chlorine-releasing agents such as the chlorinated isocyanates. Some drying conditions can actually produce agglomerates which are too dry on the surface and too moist in the core. The particle size of the agglomerate is a factor which affects drying efficiency, since agglomerates larger than +4 or even +6 mesh (U.S. Standard) are difficult to dry uniformly. The disclosure of DT-OS '701 (page 13, line 19 et seq) suggests that need for drying depends upon the relationship between the amount of water added to the agglomerate and the water of hydration of salts in the agglomerate, i.e. the need to evaporate free water. It has more recently been found that this teaching failed to take into account the complex set of factors described previously, e.g. the end use of the product, possible rate-determining steps such as the relative rates of hydration of the various salts in the composition, the residence time in the agglomerator, and the possibility of product storage at mildly elevated temperatures, e.g. 35° or 40°C. In short, conditions apparently do exist under which a variety of previously unforeseen or poorly understood problems can arise for a single-stage agglomeration process.

The chlorine stability problem has been carefully studied by several different workers in this field; see U.S. Pat. Nos. 3,248,330; 3,350,318 (col. 4, line 73 et seq.); 3,359,207 (col. 2, line 27 et seq); 3,356,612; 3,640,876; and 3,650,961.

Caking problems have also been studied. It has been suggested that caking tendencies of detergents containing condensed phosphate salts can be reduced or eliminated if these phosphate salts are fully hydrated. For example, sodium tri polyphosphate (hereinafter called STP) forms a hexahydrate; this means that the fully hydrated salt contains about 23 wt. % of water. It has also been suggested, on the other hand, that anhydrous STP is useful for its chemical drying capability in an agglomeration process. Still other prior art disclosures treat anhydrous STP and partially hydrated STP as substantial equivalents; see DT-OS '701, page 6, last paragraph. It has also been recognized that the hydration of STP to form STP·$6H_2O$ or the like may not be a straightforward reaction; see U.S. Pat. No. 2,909,490, column 2, lines 25 – 64 and the Examples. In short, for single-stage sliding bed agglomeration processes, there does not appear to be any simple way to avoid the caking problem through manipulation of the hydration reaction which converts anhydrous or partially hydrated STP hexahydrate in or on the bed.

Despite these prior art problems, this invention contemplates a single-stage sliding bed agglomeration process with a very short residence time for the condensed phosphate in the sliding bed and with no significant sacrifice of chlorine stability and resistance to caking tendencies.

SUMMARY OF THE INVENTION

This invention involves a number of interrelated discoveries.

First, it has been found that hydration rate of condensed phosphates (such as STP) is a principal rate-determining step in the type of single-stage agglomeration process described in DT-OS '701. Hardness-sequestering salts such as STP apparently hydrate rather slowly as compared to some of the common builder salts. Therefore, the agglomeration rate can be speeded up to its physical lower limit of a few seconds (as compared to a few minutes) by commencing or completing the hydration of the condensed phosphate prior to the time the condensed phosphate actually contacts the sliding bed. A simple means for accomplishing this pre-hydration of the condensed phosphate salt is to use the fully hydrated salt as the raw material fed to the disc (along with the builder salts, etc.). However, full hydration (e.g. 6 moles of water per mole of STP), while desirable to help avoid the "cup caking" phenomenon, is not essential to good storage stability for the detergent. In fact, in some cases it can be desirable to have a very small amount of hydratable salt present during storage to serve as a water scavenger. A good "head start", typically at least about 2 moles of water per mole of condensed phosphate salt, will permit sufficient hydration of the condensed phosphate during a very short (less 6 minutes, preferably less than 2 minutes) sliding bed residence time. For suitable condensed phosphate salts such as STP, the salt will ordinarily be provided with more than 8% or 9% by weight of water before agglomeration begins, an exemplary range being 10–15 wt. %. The amount of water needed for a good head start varies with the nature of the condensed phosphate. e.g. its molecular weight.

Second, the condensed phosphate, due to its relatively slow hydration rate, has to compete with other hydratable salts for free (unbound) water available during the agglomeration step. Even if enough water is present to theoretically hydrate all of the salts in the detergent composition, the actual distribution of the water (chemically and physically) throughout the resulting agglomerated material may be the source of potential problems in further processing or handling of the composition or in performance characteristics in the washing machine. Thus, an apparently fully dried, free-flowing agglomerated detergent product may not be all that it seems. The condensed phosphate salt component of the composition can still be capable of taking on additional water of hydration. The hydrated builder salt crystals may be capable of giving up some of their water of hydration during warm storage conditions, thus providing a latent source of moisture which can adversely affect both chlorine stability and resistance to caking. To be speeded up, therefore, a single-stage sliding bed agglomeration process is preferably designed to provide (1) a controlled level of water of hydration for those salts which hydrate slowly but form stable hydrates and (2) maximum level of decomposition of unstable hydrates prior to packaging of the agglomerated product.

Third, it has been found that at least some thermally assisted dehydration of the agglomerated product is an important feature of the rapid, single-stage sliding bed agglomeration process when any of a wide variety of detergent builder salts are present in the composition and particularly when these detergent builder salts help to chemically dry the agglomerates through formation of thermally unstable hydrate salts. Typically, these detergent builder salts form hydrates which decompose or melt and thereby release water at temperatures well below 100°C.; in fact, the decomposition temperature or melting point can be well within the typical warm storage temperature conditions discussed previously, e.g. near 33°C. This relative thermal instability should be contrasted with the relative stability of a hydrate such as STP hexahydrate, which decomposes at about 105°C. Thus, thermally assisted dehydration/drying conditions can be controlled so that both free or uncombined water and thermally removable water of hydration (i.e. water of hydration removable at temperatures below the dehydration or decomposition temperature of stable condensed phosphate hydrates such as STP hexahydrate) can be removed from the agglomerates without substantial loss of chlorine from chlorine-releasing agents in the composition or breakdown of the relatively stable hydrated condensed phosphate salts. The need for some thermally assisted dehydration is particularly acute when a sodium silicate is added to the composition in the form of an aqueous spray. The solids content of any useful or practical aqueous silicate spray is likely to be less than 50 or 60 wt. %. Thus, the amount of water added along with the silicate is likely to be greater than needed for agglomeration purposes, though less than the total theoretical water of hydration requirements of the system, e.g. less than 16 moles of water for the sum of one mole of STP plus one mole of sodium carbonate. The moist agglomerates discharged from the sliding bed, with the silicate spray technique, can nevertheless contain some uncombined water (due to the short residence time) and thermally removable water of hydration (due to the relative thermal instability of salts such as $Na_2CO_3 \cdot 1OH_2O$), both of which can be effectively removed by raising the temperature of the agglomerates to at least the decomposition temperature or melting point of the thermally unstable hydrates, e.g. to temperatures above 33°C. Typical moist agglomerates emerging from the sliding bed contain about 3 – 10% by weight thermally removable water of hydration and a total water content (including such water of hydration) of about 20 – 25 wt. %. Surprisingly, physical drying at these mildly elevated temperatures does not adversely affect the stability of typical chlorine-releasing agents, e.g. the chlorinated isocyanuric acid derivatives. Furthermore, if any chemical drying (i.e. hydrated salt formation) is to be relied upon during high throughput, single-stage, sliding bed agglomeration, it now appears that the rapid formation of unstable hydrates (e.g. sodium carbonate hydrates having a higher level of hydration than the monohydrate) is the best means to this end (provided an adequate drying step follows agglomeration). Hydration reactions involving the condensed phosphate are not generally a reliable and effective means of water uptake in this type of rapid agglomeration process; in fact, condensed phosphates pre-hydrated to a stable hydrate salt (e.g. STP hexahydrate) are operative in this invention as feed materials.

Briefly summarized, then, this invention involves modifying the process disclosed in DT-OS '701 such that:

a. at least about 2 moles of water have already been added to each mole of the alkali metal condensed polyphosphate prior to the time that the condensed polyphosphate contacts the sliding bed, b. the residence time on the sliding bed is kept short, e.g. less than 6, preferably less than 2 minutes, and c. the agglomerates resulting from this rapid, continuous, single-stage agglomeration are thermally dried and dehydrated by heating conditions which selectively remove thermally removable water of hydration without reducing other chemically bound water content (e.g. of condensed polyphosphates) below desired levels. The dryer will typically provide a dryer/dehydrating zone temperature above 40°C., and the agglomerates will be exposed to this temperature until the agglomerated particles have obtained a temperature ranging from about 33°C. to a temperature safely below the decomposition temperature (or melting point) of the hydrated condensed phosphate. It is also important to remove the agglomerates from the dryer as soon as the thermally removable water of hydration and uncombined water have been substantially driven off. Excessive exposure to drying conditions after the water in the composition has reached a low level could lead to the formation of water insoluble matter in the composition or could adversely affect temperature-sensitive components of the composition, e.g. the chlorine-releasing agent. In any event, the drying step is preferably short enough in duration to be compatible with a continuous, high production process.

DETAILED DESCRIPTION OF THE INVENTION

This invention involves selection of suitable detergent ingredients and processing conditions. The apparatus (agglomerator, dryer, conveying equipment, etc.) used to practice the process consists by and large of commercially available or conventional components. Thus, the person skilled in the art will be able to select suitable apparatus based on a brief description of major pieces of equipment used in the process.

APPARATUS

The preferred type of agglomerator is generally referred to as rotating inclined disc or pan type. A particularly suitable inclined disc or pan apparatus is disclosed in FIGS. 1 – 4 of the aforementioned DT-OS '701. The basic inclined pan or disc structure is also well described in commercial literature published by Dravo Corporation.

As is particularly well illustrated by the Drawings of DT-OS '701, the dry, solid ingredients (with or without pretreatments such as spraying with liquid non-ionic surfactants, commingling of raw materials, etc.) can be distributed properly on the disc by a suitable feeding tube, and the aqueous agglomerating medium can be sprayed onto the resulting sliding bed by a suitable spray nozzle. More than one spray nozzle can be used, so that, for example, aqueous sodium silicate can be sprayed on from one nozzle and a liquid foam-suppressing non-ionic surfactant (full strength or diluted with water or solvents) or the like can be sprayed on from a second nozzle. The agglomerates discharged from the sliding bed can be conveyed to a suitable dryer by a conventional conveyor belt, or, preferably, by a gravity feed similar to the feeding tube arrangement placed over the disc. A gravity feed is easily arranged in any plant with enough space to locate the agglomerator on a higher level than the dryer.

The dryer can be, for example, the rotating, elongated horizontal drum type wherein hot air is introduced all along the length of the drum. With a suitable rotating drum dryer (e.g. the "Roto-Louvre" dryer supplied by Link-Belt Division of FMC Corporation) a continuous or substantially continuous throughput from the raw material feed to the rotating disc agglomerator to the dryer to receiving or collecting the final product can be arranged. The hot, dry selectively dehydrated product emerging from the dryer can, if desired, be screened through one or more standard sieves. Oversize particles can be crushed (e. g. to −8 mesh or, preferably, to − 10 or − 12 mesh) and fines (typically resulting from this crushing of oversized particles) can be recycled as raw material fed to the agglomerator. It is generally desirable to cool the properly-sized agglomerate fraction (i.e. the product fraction) to normal ambient temperatures by any suitable means.

Thus, a large, high production output is possible with basically two major pieces of equipment; the rotating disc agglomerator and the rotating drum dryer.

DETERGENT INGREDIENTS

As is known in the art, all detergents have in common their ability to clean, but the similarity may end there. For example, laundry detergents often are mildly alkaline and are capable of generating foam which helps to lift or carry away soil from textile materials. Hand dishwashing detergent compositions are somewhat similar to laundry detergents, and, in addition, may contain lubricants or emollients for the hands. Detergents for cleaning hard surfaces such as dishes in washing machines such as dishwashers are generally tailored for the peculiar cleaning action and environment of the wash tank of those machines, and thus are formulated somewhat differently. In machine dishwashing detergent compositions, higher alkalinity and foam suppression are normally desirable. Sequestering of hardness (alkaline earth ions, ferric ions, etc.) by means of condensed phosphates, alone or in combination with other materials, is a typical feature of the machine dishwashing process. Detergent builder salts, anti-corrosion agents, foam-suppressing surfactants, chlorine-releasing agents, and fillers ordinarily are included in a detergent formulation in addition to the condensed phosphate component. The process of this invention is particularly well-suited to producing agglomerated machine dishwashing detergent compositions for home or industrial use, particularly the typical home or consumer product, which contains all or nearly all of the usual machine dishwashing detergent ingredients.

THE CONDENSED PHOSPHATES

By "condensed phosphates" is normally meant the alkali metal condensed phosphate salts, well known to those engaged in the detergent industry. These salts are generally characterized by the structural formula:

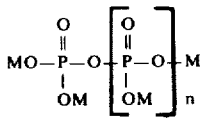

Wherein M is hydrogen or an alkali metal (at least one M being an alkali metal) and $n$ is an integer ranging from 1 to about 6. Although higher numerical values of $n$ are well known, these higher condensed phosphates have a lower water solubility, and their hydrated form is less suitable for the practice of this invention.

Typical alkali metal condensed phosphates salts useful in this invention include tetrasodium pyrophosphate, tetrapotassium pyrophosphate, sodium tripolyphosphate, (STP), other sodium polyphosphates and the like. Mixtures of these salts can, of course, be used as the condensed phosphate component. These salts can form hydrates with adequate thermal stability. For example, STP hexahydrate will not decompose under warm storage conditions (e.g. the 30° – 45°C. conditions mentioned previously).

As used in the compositions of the present invention, the amount of condensed phosphate in the detergent compositions will be at least about 2% by weight of the total agglomerated composition. Amounts up to 90% or even 95% by weight are technically possible and even desirable; however, a condensed phosphate content below 60% or 70% by weight is preferable for economic reasons. The condensed phosphate content can be reduced below 35 wt. % or even 25 wt. % through proper formulation, e.g. through combinations with other hardness sequestering agents known in the art; see U.S. Pat. No. 3,700,599 (Mizuno et al), issued Oct. 24, 1972.

HYDRATABLE DETERGENT BUILDER SALTS AND CORROSION INHIBITORS

Detergent builder salts are also well known, and at least one hydratable detergent builder salt is normally included in the composition in the amount of at least 2% but preferably less than 70% by weight. To avoid the sometimes confusing terminology used in the art, the term "detergent builder salts" is used herein primarily with reference to those salts, (generally sodium or potassium salts) included in the composition for increasing alkalinity, for inhibiting corrosion of flatware, for extending the composition, or for water conditioning by precipitation of hardness, rather than for sequestering of alkaline earth metal ions such as calcium or magnesium ion. Thus, most detergent builder salts are not hardness sequestering agents, even though they may precipitate hardness from the wash water (in machine dishwashing, sequestration is the preferred means for reducing hardness, since precipitated calcium carbonate or the like can form a film upon dishes or glassware). About the only typical example of a class of detergent builder salts which can do double duty (in the sense of also sequesting some hardness) are the alkali metal pyrophosphates. Again, for economic reasons, it would ordinarily be undesirable to replace inexpensive builders such as soda ash with pyrophosphates. Similarly, the di- and tri- alkali metal orthophosphates, though operative as builder salts, have the same economic drawback as the pyrophosphates. The preferred detergent builder salts are typically alkali metal carbonates, bi-carbonates, silicates, metasilicates, and borates. Although the carbonates (e.g. soda ash) tend to precipitate hardness (e.g. $CaCO_3$) in a manner which is less desirable than other alkali metal salts (e.g. sodium sulfate), they are inexpensive and are effective chemical drying agents during agglomeration, and, in addition, have the desired effect on the pH of the composition. The typical pH range for compositions of this invention is about 9 to about 13, preferably about 10.0 to 12.8, determined with a standard pH meter upon a 1.0 wt. % water solution of the composition.

Alkali metal metasilicates are useful builder salts or additives and can be added to the composition in dry or dissolved form. The metasilicates are sufficiently alkaline to significantly elevate pH and have some corrosion inhibiting properties. Alkali metal silicates with silica/sodium oxide ratios higher than the metasilicates are effective corrosion inhibitors, though these high ratios (e.g. 1.5:1 to 3.25:1 in $SiO_2$:$Na_2O$) make them less effective in raising pH. These silicates are most conveniently and economically obtained in the form of aqueous sodium silicate solutions containing about 35 to about 50 wt. % solids. As noted previously, the aqueous sodium silicate solutions can be used as a source of water for the agglomeration step of the process. The sodium silicates can also be added in dry form, in which case the moistening agent during the agglomeration step can be water per se, an aqueous solution of a suitable surfactant, etc. The various detergent builder salts (as defined herein) do not work with equal effectiveness, particularly with regard to providing an anhydrous material which will readily pick up water during agglomeration and will release it during the thermally assisted drying or dehydrating step. Sodium and/or potassium carbonate are generally preferred for this purpose. At least in theory, sodium carbonate or sodium carbonate monohydrate can be raised to higher levels of hydration, e.g. the heptahydrate or decahydrate level, fairly rapidly. At mildly elevated temperatures (e.g. 33° – 60°C) the higher hydrates of sodium carbonate revert to the monohydrate form, which is generally storage stable.

CHLORINE RELEASING AGENTS

Most dishwashing detergent compositions (as well as other detergent compositions) contain an agent which sanitizes the articles being cleaned through the biocidal or biostatic effect of chlorine. The chlorine is released by the sanitizing agent while the articles are being washed. Needless to say, it is detrimental to the function of the detergent composition if the chlorine is released prematurely. The chlorine releasing (sanitizing) agents used in this invention are solids and (to provide good chlorine retention prior to use) are preferably derived ultimately from isocyanuric acid. Among these agents are potassium and sodium dichloroisocyanate, trichloroisocyanuric acid, and "double salts" or crystalline complex salts or hydrated salts thereof (see U.S. Pat. No. 3,272,813). Other less preferred chlorine releasing agents not related chemically to isocyanuric acid are well known, e.g. chlorinated trisodium phosphate, trichloromelamine, and the like. The preferred chlorine-releasing or sanitizing agents are fully effective in amounts less than 10% or even less than 5% by weight. Based on the total weight of the composition, 0.1 – 3% of the chlorine-releasing agent is ordinarily effective.

SURFACTANTS

Although various types of surfactants are useful in detergent compositions, those which have a tendency to produce stable foam are preferably excluded or used in minimal amounts in machine dishwashing compositions. The preferred surfactants of this invention have a cloud point of about 45°C. or less, determined in distilled water at a concentration of 1%. These preferred surfactants, at 0.1 wt. % concentration, have Ross-Miles test values indicating the formation of very little stable foam after several minutes, e.g. Ross-Miles foam height values of less than 45mm/15mm (initial value/5 minute value). Typical of these preferred low-foaming or de-foaming surfactants are non-ionic surfactants containing oxyethylene and, if desired, some oxypropylene units. See, for example, U.S. Pat. No. 3,048,548, issued Aug. 7, 1962 and U.S. Pat. No. 3,442,242, issued May 13, 1969. Another useful low foaming surfactant system is a blend of low foaming oxyethylene-oxypropylene adduct and an alkyl phosphate ester as described in U.S. Pat. Nos. 3,314,891 (Schmolka et al) and 3,595,968 (Groves).

The aforementioned surfactant (or blend of surfactants) is ordinarily added as a liquid and in limited amounts (e.g. 0 – 5% by weight of the total formulation) by any convenient means such as spraying. It can be sprayed, at full strength or in solution, onto a raw material (e.g. the condensed polyphosphate) or directly onto the sliding bed.

OTHER INGREDIENTS

Depending upon the end use and desired performance characteristics of compositions of this invention, fillers (including neutral salts), anti-caking agents, coloring agents, alkali metal hydroxides, and the like can be included as dry solids, or sprayed onto the sliding bed as solids dissolved or suspended in water. Alkali metal hydroxides (e.g. caustic soda, KOH, etc.) can be included in the composition in minor amounts, preferably less than 5 wt. %. Larger amounts can have undesired effects upon the moisture uptake and drying conditions used in this invention. Neutral alkali metal salts such as sodium sulfate (preferably anhydrous) are useful in combination with alkaline detergent builder salts (e.g. sodium or potassium carbonate). Sodium sulfate precipitates hardness in a form which is less likely to form a visible film on clear glass. Furthermore, this salt can also serve to some extent as a scavenger for water during storage of the composition. Sodium chloride is useful as a filler in some compositions and applications where corrosion is not likely to be a problem. Other known salts occasionally used in detergents include nitrates and acetates, preferably sodium nitrate or acetate. Generally speaking, any materials which serve to emulsify and remove food soils, inhibit the foam caused by certain food soils, promote wetting of dinnerware to inhibit spotting, remove stains such as those caused by coffee and tea, prevent build-up of soil films on dinnerware surfaces, reduce or eliminate tarnishing of flatware, and destroy bacteria can be useful in compositions of this invention, provided the various criteria and limits described previously are complied with.

To sum up, a typical composition of this invention, after agglomeration, comprises:

5–60% by weight of alkali metal condensed polyphosphate (not including water of hydration), 2–70% (e.g. 10–40%) by weight of at least one inorganic alkali metal detergent builder salt, such as a carbonate, orthophosphate, pyrophosphate, metasilicate or borate (not including water of hydration, if any), 0.1–10% by weight of an alkali metal salt of a chlorinated isocyanuric acid, 0–20% (e.g. up to 17%) by weight of a substantially neutral alkali metal salt (e.g. sodium sulfate), 0–5% by weight of the surfactant, 0–5% by weight of an alkali metal hydroxide, and about 5–20% by weight of the sodium silicate (as solids), e.g. 25–35% by weight sodium silicate as an aqueous solution. (The preferred sodium silicates have a silica/sodium oxide ratio of 1.6:1 to 3.22:1.)

The composition is dry and contains only tract amounts of free water, if any. The water in the composition is essentially in the form of water of hydration, e.g. hydrated condensed phosphate, sodium carbonate monohydrate, hydrous silicate, and the like. The total amount of bound water in the composition is typically not more than about 20 or 25% by weight, but generally will not be less than about 10 or 15% by weight.

THE PROCESS

The first step in the process of this invention preferably involves providing a condensed phosphate brought to a minimum level of hydration. This partially hydrated condensed phosphate is then distributed onto the sliding bed (with or without previous commingling with other ingredients) with other dry solid ingredients, such as: at least one substantially anhydrous, particulate, detergent builder salt capable of forming a hydrate which is unstable or molten at temperatures above 33°C. but well below 100°C.; the chlorine-releasing agent; and the like. The sodium silicate is typically added in the form of aqueous solutions or suspensions sprayed onto the sliding bed. Liquid surfactants can be sprayed onto dry or partially hydrated raw materials during or prior to agglomeration. In the process of this invention, the condensed phosphate salts, a detergent builder salt, and the chlorine-releasing agent can be simultaneously commingled and agglomerated on the sliding bed. This invention does not require multiple stage agglomeration, special particle coating for encapsulation steps, or any other relatively complex operations often used to ensure chlorine stability for the chlorinated isocyanurates. Fully hydrated STP hexahydrate can be provided or selected as a raw material for the process of this invention. The hexahydrate theoretically contains about 23% by weight of bound water. It has been found that it is not necessary to prehydrate the STP all the way up to this 23% level, however. More than 8% by weight (corresponding to at least about 2 moles of water per mole of STP) can be adequate. A hydration level of at least about 9 or 10% by weight appears to give the STP a sufficient head start, so that it will be sufficiently hydrated during the very short residence time in the agglomerator, despite the competition for available water resulting from the presence of anhydrous or partially hydrated sodium carbonate. At least some of the water added to the STP is thus apparently in the form of water of hydration even before this partially hydrated STP comes into contact with other hydratable salts on the sliding bed.

In one embodiment of the invention, at least partially hydrated condensed phosphate, builder salt, and chlorine-releasing agent are fed through the same distributor or feed means (along with recycled fines, if any) and simultaneously commingled and agglomerated on the rotating disc. In another embodiment, the detergent builder salt (including any neutral salts such as sodium sulfate) and the chlorine-releasing agent are fed to the disc, while the condensed phosphate is added by itself to a different portion of the disc where it can be passed through a water spray (for pre-hydration) before it is distributed onto the sliding bed along with the other dry detergent ingredients.

Thus, the pre-hydration of the condensed phosphate can be provided for in any suitable manner prior to commencing the single-stage agglomeration process and prior to commencing the hydration reactions which occur during the agglomeration. Furthermore, the combination of the pre-hydrated condensed phosphate and the other dry solid ingredients can be commingled prior to the single stage agglomeration, but such pre-mixing is not necessary. The condensed phosphate can be hydrated and stored until needed; a hydration step can be set up as a continuous pre-treatment of anhydrous condensed phosphate raw material; or the pre-treatment step can be reduced in time to a matter of seconds by the water spray approach described previously. One method for providing this short duration but adequate pre-hydration is to add the anhydrous condensed phosphate directly to the agglomerator disc (e.g. at 1 o'clock) so that it will pass through the water spray and obtain a head start on hydration prior to the time that all the other ingredients are introduced for agglomeration (e.g. at 5 or 6 o'clock on a clockwise rotating disc). For all practical purposes, no agglomeration of the condensed phosphate occurs during the pre-hydration step since a single-stage agglomeration is desired.

As the dry components (i.e. those added essentially as particulate solids rather than as solids dissolved or suspended in water) are distributed onto the generally planar, inclined, rotating and sliding (or scouring) bed, spraying the bed with at least an agglomerating amount of a suitable aqueous medium will result in a rather well controlled agglomeration of the particulate solids. As pointed out previously, water per se, water containing a surfactant, and aqueous sodium silicate solutions are among the suitable aqueous media. A few percent by weight of pure water can be sufficient to provide agglomeration. However, when the aqueous medium includes a dissolved sodium silicate, the amount of water added to the sliding bed is ordinarily in excess of the amount needed purely for agglomeration. The residence time in the agglomerator can be surprisingly short; as pointed out previously "residence time" is defined as weight on the bed divided by total feed rate. As in the DT-OS '701 process, the agglomerates quickly attain sufficient size to slide down the disc under their own weight and spill over the bottom area (generally along the 5 to 7 o'clock position) of the retaining ring of the rotating disc (or the bottom wall of the inclined pan). This automatic size classification and discharge of agglomerates from the disc is followed by conveying of the agglomerated particles to the heating drum, e.g. by a gravity feed or conveyor belt. The manner in which this residence time and discharge rate (with the attendant conveying to the dryer) can be controlled is through appropriate selection, arrangement, and manipulation of the equipment. As the person skilled in the art will readily appreciate, several factors can be varied at will to control agglomerator residence time and agglomerate size, e.g. feed rate to the disc, angle of the disc, rotational speed of the disc, number and location of water sprays, etc.; see DT-OS '701, particularly the discussion of FIGS. 1 – 4. The result of such manipulation is a very adequate control over the particle size and particle density of the agglomerates (i.e. enlarged, composite particles) sent to the dryer. Normally, at least 60% by weight of the agglomerates discharged from the disc are firm particles within the size range of – 4 +80 mesh in the U.S. Standard Sieve Series. After drying, the oversize agglomerates can be crushed or scalped to the desired maximum size (e. g. –8, – 10, or –12 mesh) and fines capable of passing an 80 mesh, or if desired, 60 mesh screen on the U.S. Standard Scale can be recycled to the agglomerator. With proper care, oversized particles can be reduced to less than 10 or even less than 5% by weight of the agglomerates, and fines (except for those fines resulting from crushing of the oversize material) can be almost eliminated.

The agglomerates discharged from the sliding bed are conveyed to a heated drying or dehydrating zone typically provided by an elongated, substantially horizontally oriented, rotating drum dryer in which hot, dry air is introduced along the entire length of the drying zone. The drying zone thus has an ambient temperature well above room temperature, generally at least above 33°C. and preferably above 40°C., since one of the objectives of the drying step is to elevate the agglomerates to a temperature at which absorbed free water and undesirable or thermally removable waters of hydration will be driven off. That is, the agglomerates are raised to at least 33°C. and preferably to at least 40°C. Agglomerate temperatures (as opposed to drying zone ambient temperatures) as high as 50° or even 60°C. will drive off the water in less than 2 hours, typically in about 0.2–1 hour, depending on the hot air flow rate through the dryer. If the drying zone residence time is less than about 0.2 hours, the resulting product either could contain some undesired moisture or could be degraded by the high temperatures needed to achieve full drying in such a short span of time. The agglomerates themselves should be kept safely below the decomposition temperature of the hydrated condensed phosphate—in other words, safely below about 100°C. (The decomposition temperature of STP hexahydrate is about 105°C.) For the higher hydrates of sodium carbonate, this presents no problem, since they readily revert to sodium carbonate monohydrate in the 33° – 60°C. range. For hydrates of sodium metasilicate, on the other hand, an agglomerate temperature as high as 75°C. would be required if this salt were to be fully dehydrated. Fortunately, there is ordinarily no need for such high temperature dehydrations. Hydrates with this level of stability would not be likely to decompose even under the warmest storage conditions.

As the skilled artisan will readily appreciate from the foregoing disclosure, time, temperature, and air flow rate are inter-related during the drying step. Bringing the agglomerates to 60° or 75°C. (through the use of very high ambient temperatures in the dryer) can shorten the residence time in the dryer, while the use of mildly elevated temperatures may result in a need for residence times even longer than 2 hours. Long drying residence times depress the production rate and can result in chlorine stability problems or the formation of water-insoluble silicates. Short residence times in the dryer may increase the apparent production rate, but the risk of adversely affecting the stability of the agglomerates and/or incompletely drying them is high. Thus, there may be no real advantage in decreasing the drying zone residence time below about 20 or 25 minutes.

The ambient temperature in the dryer must, of course, be at or above the temperature that the agglomerates are to reach prior to being discharged from the dryer. Thus, the heating zone provided by the dryer drum will ordinarily have an ambient temperature above about 40°C., and the temperature at the hot air inlets to the dryer will ordinarily be above 100°C., e.g. 130° – 140°C. (This 130° – 140°C. air is, of course, cooled by evaporation and the like occuring within the dryer drum.) Typically, the agglomerates discharged from the dryer are at or near their peak temperature.

It is preferred that the agglomerates discharged from the drying or heating zone enter a significantly cooler environment, e.g. a normal room temperature environment. Once the agglomerates have been properly screened and (if necessary) crushed to the desired size, further cooling by any suitable means can be desirable to remove any heat that still remains in the agglomerates from the drying step.

Agglomerates produced by this invention tend to be firm and have good physical strength. They generally resist fracture during mechanical handling.

In the following non-limiting but illustrative Examples all parts and percentages are by weight unless otherwise specified.

EXAMPLE 1

A detergent formulation was prepared in accordance with the method of the invention by combining the following materials on a 39-inch diameter inclined disc with a retaining ring around its periphery (as in DT-OS-'701).

| Component | Weight Percent |
|---|---|
| Sodium tripolyphosphate, hydrated | 49.32 |
| Sodium Carbonate | 9.77 |
| Sodium sulfate | 10.25 |
| Polyoxyalkylene surfactant | 1.08 |
| Sodium dichloroisocyanurate | 1.45 |
| Aqueous sodium silicate (46% solids, $Na_2O:SiO_2$ 1.0:2.4) | 30.66 |
| Encapsulated perfume | 0.16 |

The rpm of the disc, feed rate of raw material, angle of inclination and placement of liquid sprays was arranged to provide an agglomerator residence time of 1.7 minutes. The surfactant was the liquid, non-ionic polyoxyalkylene detergent described in U.S. Pat. No. 3,048,548 to Temple et al.

Agglomerates spilling over the retaining ring were conveyed by gravity feed into a horizontal rotary dryer (Roto-Louvre by FMC Corp.). The temperature of the hot air introduced into the dryer was 220°F. (104°C). The agglomerates emerging from the dryer were at a temperature within a few degrees of 120°F (49°C) which was approximately the peak temperature obtained by the agglomerates during the drying step. The residence time of the product in the dryer was 24 minutes.

Virtually all of the agglomerates emerging from the dryer were in the −4+60 US mesh size range. The entire product was ground in a hammermill and then screened on a 60 mesh screen. The resultant product was essentially all in the −12+60 US mesh size range plus about 20 weight percent fines were produced by grinding and they were recycled back to the agglomeration bed.

The agglomerates leaving the agglomeration bed contained about 25% by weight total moisture and those leaving the dryer contained about 15.5% by weight of total moisture.

The chlorine stability of the agglomerates was tested. Essentially no chlorine loss during agglomeration and drying could be detected. After storage of the agglomerated, dried, ground product for 4 weeks at room temperature, the available chlorine losses were only 22%.

Chemical analysis indicated no significant reversion of sodium tripolyphosphate to orthophosphate during processing and storage.

A "cup caking" test was made by determining the length of time needed to wash all of the agglomerated detergent out of a dishwasher detergent dispensing cup.

By reference to actual performance tests, it was determined that a test reading of 30 seconds or less was acceptable. Product produced by this example was found to have a test reading less than 10 second which compares very favorably to the test results for products described in U.S. Pat. No. 3,306,858 (Oberle).

EXAMPLE 2

The procedure of Example 1 was repeated with the following composition:

| Component | Weight Percent |
|---|---|
| Sodium tripolyphosphate, hydrated | 33.73 |
| Sodium carbonate | 24.37 |
| Sodium sulfate | 6.33 |
| Polyoxyalkylene surfactant | 0.95 |
| Sodium dichloroisocyanurate | 1.42 |
| Aqueous sodium silicate (46% solids, $Na_2O:SiO_2$ 1:2.4) | 33.70 |

The chlorine stability of the product made by this Example had chlorine losses of 29.5% after 4 weeks storage at room temperature.

EXAMPLE 3

The procedure of Example 1 was repeated on a 6 foot diameter inclined disc with a retaining ring around the periphery. The anhydrous sodium tripolyphosphate was prewetted with water in a Patterson-Kelley continuous liquid-solids blender as it was fed onto the disc.

| Component | Weight Percent |
|---|---|
| Sodium tripolyphosphate, anhydrous | 29.07 |
| Sodium carbonate | 27.28 |
| Sodium sulfate | 7.53 |
| Polyoxyalkylene surfactant | 0.94 |
| Sodium dichloroisocyanurate | 2.23 |
| Aqueous sodium silicate (46% solids, $Na_2O:SiO_2$ 1:2.4) | 30.42 |
| Pure water | 2.53 |

The agglomerator residence time was 2.3 minutes. Agglomerates spilling over the retaining ring were conveyed by gravity into a horizontal rotary dryer having an inlet air temperature of 267°F. The agglomerates emerging from the dryer were at a temperature of 114°F. The product residence time in the dryer was 38 minutes.

About 30% of the product emerging from the dryer was larger than 10 U.S. mesh size with almost none smaller than 60 U.S. mesh. The entire product was screened through a 12 mesh screen and on a 60 mesh screen with the oversize ground in a hammermill and recycled back through the screens. The resultant product was virtually all in the −12+60 U.S. mesh size range. About 20 weight percent fines (−60 U.S. mesh) were produced during grinding and recycled back to the agglomeration bed.

The agglomerates leaving the agglomeration bed contained about 20% by weight total moisture and those leaving the dryer contained about 16.5 by weight total moisture.

After storage of the product at room temperature for four weeks the available chlorine loss was 5%. Cup caking times as described in Example 1 were less than 10 seconds.

EXAMPLE 4

The procedure of Example 3 was repeated with the following composition:

| Component | Weight Percent |
|---|---|
| Sodium tripolyphosphate, anhydrous | 40.25 |
| Sodium carbonate | 16.41 |
| Sodium sulfate | 4.54 |
| Polyoxyalkylene surfactant | 0.97 |
| Sodium dichloroisocyanurate | 1.49 |
| Aqueous sodium silicate (46% solids, $Na_2O:SiO_2$ 1:2.4) | 29.24 |
| Pure Water | 7.10 |

The agglomerator residence time was 1.5 minutes and dryer residence time was 30 minutes. The temperature of air entering the dryer was 290°F. The temperature of the agglomerates discharging from the dryer was 120°F.

About 3.5% of the product emerging from the dryer was larger than 12 U.S. mesh size and less than 1% was smaller than 60 U.S. mesh size.

The total moisture content of agglomerates leaving the agglomeration bed was 22% and in product leaving the dryer the moisture content was 17.2%.

After storage of the product at room temperature for four weeks the available chlorine loss was 10%. Cup caking times (as described in Example 1) were 15 – 17 seconds.

EXAMPLE 5

The procedure of Example 3 was repeated with the following composition:

| Component | Weight Percent |
|---|---|
| Sodium tripolyphosphate, anhydrous | 41.88 |
| Sodium carbonate | 20.94 |
| Polyoxyalkylene surfactant | 1.05 |
| Sodium dichloroisocyanurate | 1.87 |
| Aqueous sodium silicate (46% solids, $Na_2O:SiO_2$ 1:2.4) | 29.63 |
| Pure Water | 4.64 |

The agglomerator residence time was 1.9 minutes and the dryer residence time was 34 minutes. The temperature of air entering the dryer was 262°F. and the temperature of agglomerates discharging from the dryer was 121°F.

The product was screened through a 12 U.S. mesh screen and the oversized material was ground in a hammermill and recycled to the aggomerator.

The total moisture content of agglomerates leaving the agglomeration bed was about 21% by weight and in the product leaving the dryer the moisture content was 15%.

After storage of the product at room temperature for four hours the available chlorine loss was 2.6%. Cup caking times (as described in Example 1) were less than 10 seconds.

Available chlorine analyses of the compositions made by each of these Examples were made periodically and compared with the formulation of Example 5 made by the "pre-mix" technique of Oberle, U.S. Pat. No. 3,306,858, rather than by agglomeration. Samples for these analyses were stored in plastic bottles at room temperature. The results of the analyses are as follows:

PERCENT AVAILABLE CHLORINE RETAINED

| | Ex.1 | Ex.2 | Ex.3 | Ex.4 | Ex.5 | "Pre-Mix" (Non-agglomerated) Product |
|---|---|---|---|---|---|---|
| 14 days | 79.4 | 75.9 | 93.3 | 91.7 | 96.9 | 86.7 |
| 21 days | 79.7 | 78.3 | 96.5 | 87.3 | 96.8 | 79.8 |
| 28 days | 78.0 | 71.5 | 95.9 | 90.1 | 97.4 | 81.7 |
| 35 days | 80.1 | 75.0 | — | 82.5 | 96.2 | 79.6 |
| 45 days | — | — | 94.0 | — | 96.0 | 80.7 |
| 60 days | 75.5 | — | 90.9 | — | — | 79.8 |
| 75 days | 67.8 | — | 82.5 | — | 94.4 | 68.2 |
| 90 days | 64.4 | — | 81.2 | — | 91.2 | 68.0 |
| 120 days | 58.3 | — | 74.3 | — | 85.7 | 61.9 |

The stability of the products made by these Examples was surprising in view of prior art teachings that de-foaming surfactants, chlorine-release agents, detergent builder salts, liquid silicate solutions and/or STP must be added in one or another specific sequences to protect chlorine stability (U.S. Pat. Nos. 3,761,416; 3,625,902; 3,359,207; 3,248,330). In these Examples, these materials were substantially continuously fed directly to the agglomerator and thereby mixed and agglomerated at the same time. Although this invention is not bound by any theory, it is assumed that there are non-porous protective barriers of sodium silicate within each agglomerated particle which inhibit migration of chlorine and de-foamer.

What is claimed is:

1. A continuous single-stage agglomeration process for producing an agglomerated detergent composition comprising the steps of:

a. distributing substantially non-agglomerated particles onto a generally planar, inclined, rotating, sliding bed of particles of detergent ingredients, said substantially non-agglomerated particles consisting essentially of:

1. an at least partially hydrated condensed phosphate salt capable of sequestering hardness-causing metal ions and capable of retaining all of its water of hydration until heated at least to a decomposition temperature above 45°C., said condensed phosphate salt being a sodium or potassium salt of the formula

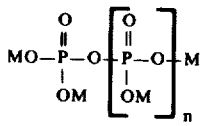

wherein M is hydrogen, sodium, or potassium, at least one M being sodium or potassium, and $n$ is a number ranging from 1 to about 6;

2. a solid chlorine-releasing agent selected from the group consisting of chlorinated isocyanuric acid; a sodium salt of said acid; a potassium salt of said acid; and sodium and potassium double salts, crystalline complex salts, and hydrated salts of said acid;

3. a hydratable detergent builder salt capable of forming a hydrate salt which decomposes and releases at least some of its water of hydration at a decomposition temperature below said decomposition temperature of said condensed phosphate salt; said hydratable detergent builder salt being selected from the group consisting of the following sodium and phosphate salts: the carbonates, bicarbonates, orthophosphates, pyrophosphates, borates, metasilicates, and silicates with a higher silica/sodium or potassium oxide ratio than metasilicate, said ratio ranging up to 3.25:1;

b. continuing the rotation of said bed and contacting said substantially non-agglomerated particles with water in an amount at least sufficient to:

1. form a partially hydrated detergent builder salt, and 2. cause said substantially non-agglomerated particles to agglomerate to form enlarged, composite particles;

c. conveying said enlarged composite particles, after a residence time on said bed of less than 15 minutes, to a heating zone in which the heating conditions are sufficient to raise said enlarged composite particles to a peak temperature at least equal to a temperature below said decomposition temperature of said phosphate salt, at which the hydrated detergent builder salt resulting from said step b. will converted to a lower level of hydration which is stable under normal storage and handling conditions;

d. discharging said enlarged, composite particles from said heating zone into a relatively cooler environment no earlier than the time said lower level of hydration has been reached but before said chlorine-releasing agent has decomposed and become ineffective as a chlorine source.

2. A process according to claim 1 wherein said detergent builder salt is a non-sequestering salt selected from the group consisting of the alkali metal carbonates, di- and tri-alkali metal orthophosphates, alkali metal silicates, and alkali metal borates, said alkali metal being selected from the group consisting of sodium and potassium.

3. A process according to claim 1, wherein said substantially non-agglomerated particles include 0 – 20% by weight of anhydrous sodium sulfate and 0 – 5% by weight of an alkali metal hydroxide selected from the group consisting of caustic soda and KOH.

4. A process according to claim 1 which comprises the steps of:

I. adding at least about 2 moles of water to each mole of sodium or potassium condensed phosphate salt to obtain said partially hydrated condensed phosphate salt prior to said step (a);

II. discharging from said inclined, rotating, sliding bed the agglomerates resulting from said step (b) after less than 6 minutes residence time in said inclined, rotating, sliding bed;

III. heating the agglomerates obtained from said step II in a heating zone having an ambient temperature above 40°C. until said agglomerates reach a temperature of at least about 33°C.; and IV. removing said agglomerates from said heating zone to a relatively cooler environment as soon as said agglomerates have reached a storage stable condition.

5. A process according to claim 1 wherein:

at least some of the enclarged, composite particles discharged from said heating zone in step (d) are small enough to pass a 4 mesh U.S. Standard Screen and at least some of said enlarged, composite particles are large enough to be retained on 80 mesh U.S. Standard Screen;

said enlarged composite particles are screened subsequent to said step (c) to a size range of about 0.25 to about 2.5 mm; and particles smaller than about 0.25 mm passing through the screen are recycled for use in said step (a);

and wherein the residence time on said bed in said step (b) is less than 6 minutes.

6. A process according to claim 1 wherein at least about 2 moles of water is added to each mole of said condensed phosphate salt to obtain the partially hydrated condensed phosphate salt of said step (a) (1).

7. A process according to claim 1 wherein the water used in step (b) contains dissolved or suspended solids, and wherein the amount of water used to complete step (b) is less than the combined theoretical maximum water of hydration of the hydratable salts included in said detergent ingredients and said dissolved or suspended solids.

8. A process according to claim 1 wherein:

a. said at least partially hydrated condensed phosphate salt is substantially fully hydrated;

b. the water used in step (b) is substantially free of dissolved or suspended solids; and c. said water is sprayed onto said substantially non-agglomerated particles in an amount sufficient to agglomerate said particles but not sufficient to fully hydrate any hydratable salts in said non-agglomerated particles.

9. A process according to claim 1 wherein said step (a) is carried out by:

1. feeding a substantially anhydrous alkali metal condensed phosphate salt having a particle size range small enough to pass a 60 mesh U.S. Standard Screen to a generally planar, inclined, rotating disc agglomerator, 2. spraying said condensed phosphate salt, while on said disc agglomerator, with water under non-agglomerating conditions until said condensed phosphate salt has taken up more than 8% by weight of water, 3. physically adding said chlorine-releasing agent and said hydratable detergent builder salt to the resulting partially hydrated condensed phosphate salt, and 4. agglomerating the combination provided by step (3) on said rotating, sliding bed.

10. A process according to claim 1 wherein said at least partially hydrated condensed phosphate salt has taken up more than 8% by weight of water prior to said step (a), and wherein at least some of said water is in the form of water of hydration.

11. A process according to claim 1 wherein said heating zone has an ambient temperature above 40°C.; wherein said enlarged, composite particles are brought to a maximum temperature of about 40° to about 60°C.; and wherein the total residence time of said enlarged, composite particle in said heating zone is greater than about 0.2 but less than about 2 hours.

12. A process according to claim 6 wherein said partially hydrated condensed phosphate salt of said step (a) (1) contains at least about 10% by weight of water, and at least some of said water is water of hydration of the compound sodium tripolyphosphate hexahydrate.

13. A process according to claim 7 wherein said solids comprise a sodium silicate having an $SiO_2/Na_2O$ ratio in the range of about 1.5:1 to about 3.25:1, and wherein the enlarged, composite particles obtained from said step (d) contain more than 10% but less than 20% by weight of water as water of hydration and water in hydrous sodium silicate.

14. A process according to claim 7 wherein chemical drying of said enlarged, composite particles occurs during said step (b) due to hydration of said hydratable detergent builder salts.

15. A process according to claim 10 wherein said at least partially hydrated condensed phosphate salt is sodium tripolyphosphate containing about 10 to about 23% by weight of water.

16. A process according to claim 4, wherein the said residence time in said inclined, rotating, sliding bed is less than two minutes.

17. A continuous process for agglomerating and blending particulate ingredients of a detergent composition, said process comprising the steps of:

(a) feeding a composition to a generally planar, inclined, rotating and sliding bed, said composition comprising:

1. 5 – 60% by weight of particulate sodium tri-polyphosphate, brought at least partially to the hexahydrate state and containing about 9 to about 23% by weight of water, based on the weight of said sodium tripolyphosphate, 2. 2 – 70% by weight of at least one substantially anhydrous, particulate, inorganic alkali metal alkaline detergent builder salt selected from the group consisting of a carbonate, an orthophosphate, a pyrophosphate, a metasilicate, and a borate, said alkali metal being selected from the group consisting of sodium and potassium;

3. 0.1 – 10% by weight of a particulate sodium or potassium salt of a chlorinated isocyanuric acid; and 4. up to 20% by weight of anhydrous particulate sodium sulfate;

b. continuously spraying an agglomerating amount of water onto said rotating and sliding bed, c. maintaining a residence time for said composition on said sliding bed which ranges from about 10 seconds to about 2 minutes, whereby agglomerated particles containing said composition are produced, at least 60% by weight of said agglomerated particles having a size range of —4 + 80 mesh on the U.S. Standard Scale, d. continuously conveying the agglomerated particulates resulting from the preceding steps to a heated drying and dehydrating zone and maintaining said agglomerated particles in said drying and dehydrating zone for at least about 0.2 but less than about 2 hours until said agglomerated particles reach a temperature of at least 40°C. but less than 60°C., and e. discharging the resulting dried agglomerated particles from said drying and dehydrating zone into a relatively cooler environment.

* * * * *

UNITED STATES PATENT OFFICE

CERTIFICATE OF CORRECTION

PATENT NO. : 3,933,670

DATED : January 20, 1976

INVENTOR(S) : John B. Brill, Charles A. Morris, and Soo-Duck Moon

It is certified that error appears in the above-identified patent and that said Letters Patent are hereby corrected as shown below:

Column 3, line 40, for "3,640,876" read --3,640,875--.
Column 4, line 29, for "less 6" read --less than 6--.
Column 4, line 35, head start should have quotes --"head start"--.
Column 4, line 60, for "(2) maximum" read --(2) a maximum--.
Column 6, line 40, for "as rotating" read --as the rotating--.
Column 8, line 44, for "sequesting" read --sequestering--.
Column 9, line 12, detergent builder salts should have quotes --"detergent builder salts"--.
Column 10, line 64, for "tract" read --trace--.
Column 11, line 21, for "salts" read --salt--.
Column 11, line 25, for "for" read --or--.
Column 11, line 37, head start should have quotes --"head start"--.
Column 12, line 9, head start should have quotes --"head start"--.
Column 15, line 4, for "second" read --seconds--.
Column 16, line 52, for "aggomerator" read --agglomerator--.
Column 17, line 66, for "phosphate" read --potassium--.
Column 18, lines 20 and 21, "b." has been deleted from the beginning of line 21 and inserted at the end of line 20.
Column 18, line 21, for "will converted" read --will be converted--.
Column 18, line 61, for "enclarged" read --enlarged--.

Signed and Sealed this

Tenth Day of August 1976

[SEAL]

*Attest:*

RUTH C. MASON
*Attesting Officer*

C. MARSHALL DANN
*Commissioner of Patents and Trademarks*